United States Patent [19]

Wong

[11] 4,071,415

[45] Jan. 31, 1978

[54] METHOD OF ELECTROPLATING ALUMINUM AND ITS ALLOYS

[76] Inventor: Jack Yea Wong, 4791 Calle de Lucia, San Jose, Calif. 95124

[21] Appl. No.: 734,679

[22] Filed: Oct. 21, 1976

Related U.S. Application Data

[63] Continuation-in-part of Ser. No. 645,552, Dec. 31, 1975, Pat. No. 4,003,804.

[51] Int. Cl.[2] ..... C25D 3/44; C25D 21/16; C25D 21/18

[52] U.S. Cl. ..... 204/14 N; 204/234; 204/237

[58] Field of Search ..... 204/14 N, 39, 234, 235, 204/237, 238, 275, 276

[56] References Cited

U.S. PATENT DOCUMENTS

| | | | |
|---|---|---|---|
| 1,601,692 | 9/1926 | Merritt | 204/234 |
| 1,820,204 | 8/1931 | Wilkins | 204/234 |
| 2,170,375 | 8/1939 | Mathers et al. | 204/14 N |
| 3,775,260 | 11/1973 | Capuano et al. | 204/14 N |
| 3,997,410 | 12/1976 | Gileadi et al. | 204/14 N |
| 4,003,804 | 1/1977 | Wong | 204/14 N |

OTHER PUBLICATIONS

Electrodeposition of Aluminum from Non Aqueous Solutions, R. D. Blue et al., J. Elect Soc. Preprint 65-2, Apr. 30, 1934, pp. 25-38.

*Primary Examiner*—T. M. Tufariello
*Attorney, Agent, or Firm*—I. Morley Drucker

[57] ABSTRACT

Aluminum or an alloy thereof is electroplated upon electrically conductive substrates by immersing the substrate as a cathode in a novel stable electrolyte, made as follows:

a. reacting aluminum with a hydrogen halide such as HCl, HBr, or HI (but preferably hydrogen bromide) or reacting aluminum with a halogen such as $Cl_2$, $Br_2$, or $I_2$ (but preferably bromine), in the absence of water, but in one of the following single organic, non-Lewis base solvents or mixtures thereof: benzene, toluene, carbon disulfide, cyclohexane, dimethyl sulfide, tetrahydrofuran, diiodoethane, toluene-cyclohexane (1:1), benzene-cyclohexane (1:1), tetrahydrofuran (THF): benzene (4:1) and toluene-$CS_2$ (3:1) to form an intermediate aluminum halide cation in solution, the concentration of the aluminum cation and the concentration of hydrogen ion, in solution being respectively, below about 7.5 M and 0.5 M and preferably being, respectively, below about 4.2 M and 0.1 M; and b. then adding a restricted amount, preferably less than about 16 mole % relative to the initial quantity of aluminum added, of a metal halide, MX where M=Li, Na, or K and X=Cl, Br, or I; or where MX is a special halide such as beryllium bromide, magnesium bromide, or quaternary ammonium bromide to form a different, stable aluminum-cationic plating species.

The novel electrolyte is then directed to a plating chamber, utilized in the plating chamber until it is aluminum ion poor, transferred to a regeneration chamber, filtered and returned to the plating chamber for further plating operations.

23 Claims, 2 Drawing Figures

METHOD OF ELECTROPLATING ALUMINUM AND ITS ALLOYS

CROSS-REFERENCE TO RELATED APPLICATIONS

This application is a continuation-in-part of copending application, Ser. No. 645,552, now patent No. 4,003,804 entitled "METHOD OF ELECTROPLATING OF ALUMINUM AND PLATING BATHS THEREFORE", filed Dec. 31, 1975, JACK YEA WONG, Inventor.

BACKGROUND OF THE INVENTION

The present invention relates to the plating of high purity aluminum or its alloys (hereinafter and in the claims, simply termed "aluminum") onto an electrically conductive substrate serving as the cathode in an electrolytic cell.

The electroplating of aluminum has been studied and investigated for over half a century by various workers. Prior art aluminum plating processes have been reviewed in detail in the applicant's said copending application. In general the majority of prior art processes are not feasible for large scale industrial application for a variety of reasons. Some processes are associated with known fire and toxicity hazards; some yield aluminum deposits that are not high purity; some electrolytic baths have normally been unstable; and some are complex and relatively expensive to formulate.

With regard to a recent publication by Peled and Gileadi entitled "*The Electrodeposition of Aluminum from Aromatic Hydrocarbons*", J. Electrochem. Soc., 123, 15 (1976) and a similar article entitled "*Electroplating of Aluminum From Aromatic Hydrocarbons*" in Plating 60, 342 (1975) it is stated that excellent aluminum deposits can be obtained from stable baths which employ relatively safe chemicals.

Peled and Gileadi describe a plating bath which requires the presence of 2 – 3 M aluminum halide and 0.1 – 1 M alkali halide, an organic non-Lewis base solvent (such as benzene and toluene) and a Lewis base such as ethylbenzene. (A Lewis base is any substance that will donate an electron pair to an electron pair acceptor (Lewis acid)).

The Peled & Gileadi process appears to have intrinsic drawbacks; thus:

Peled et al's plating baths consist of basically four (4) ingredients (while the present process requires three basic ingredients). Thus, in addition to $AlBr_3$, an organic solvent such as benzene or toluene, and an alkali bromide, the Peled et al. bath requires a Lewis base such as ethylbenzene, a large aromatic hydrocarbon, or an amine in order to yield acceptable plating. The Lewis base is apparently thought to be required by these authors, to "render the bath insensitive to trace amounts of water or HRr". Also, Lewis bases are considered to be good "bromine getters", and their presence would prevent or retard any deleterious affects of halide or halogen formed during plating by absorbing the by-products of plating. In the present invention, a "bromine-getter" or halogen-getter" is not required because: (a) neutral solvents inert to halogens such as benzene, tetrahydrofuran, and cyclohexane are used; and (b) the electrolytes of the present process, which contain the by-products of plating, are directed from the zone of plating to a column packed with activated aluminum which regenerates more aluminum cationic plating species and this regenerated electrolyte is then recirculated to the plating zone to replace the aluminum cationic plating species consumed during plating.

At any rate, Peled and Gileadi report that when a single solvent non-Lewis base system such as benzene or toluene, is employed in their plating baths, "a tarlike organic deposit containing no aluminum was formed if benzene was the solvent" and in toluene "a gray to black deposit was produced". They therefore concluded that the Lewis base was essential to a good plating performance. (In stark contrast, the applicant herein has obtained the best quality aluminum deposits, at highest current densities, when a single non-Lewis base solvent system such as toluene or benzene is used).

Some Lewis bases such as ethylbenzene and naphthalene derivatives are relatively expensive and in scarce supply. Furthermore, the employment of a Lewis base in the plating system substantially increases the resistivity of the bath. Because of such increased resistivity Peled and Gileadi report that in a majority of cases their current densities are only 5 to 10 $mA/cm^2$ at 100% current efficiency. (In the present invention, substantially increased current densities-varying from 35 to 125 $mA/cm^2$ are observed at 100%, or near 100% current efficiency.)

The work of Peled, and Gileadi, cited earlier, uses performed aluminum bromide, as do Capuano and Davenport*. Preformed aluminum bromide is relatively expensive, is in scarce supply, and is difficult to work with because it picks up water readily from the atmosphere. Water readily reacts with the preformed aluminum bromide to form aluminum oxide; this aluminum is not available for the plating operation. On the other hand, the applicant herein prepares aluminum bromide in complex form in situ, which is relatively safe to employ on a large scale. Furthermore, other aluminum halides such as $AlCl_3$ and $AlI_3$ have also been employed either, by themselves or in mixtures thereof, in some baths of the present invention (see Table I).

* See Capuano and Davenport, Canadian Patent No. 945,935 and U.S. Pat. No. 3,775,260

Thus, in summary, the present invention is directed towards a method and means for eliminating the volatile conducting species, i.e., the hydrogen ion of the hydrogen bromide gas and replacing it with a stable solid, e.g., an alkali halide, beryllium bromide, magnesium bromide, or ammonium bromide. In addition, the solvent system utilized is inert and of low resistivity thereby achieving several additional advantages for this particular system, namely: (1) increasing the conductivity of the plating solution, and (ii) improving the throwing power of the bath.

In general, compared to prior art processes known up to the present time, this invention provides the most economical and relatively-safe-to-employ method to electrodeposit high quality aluminum on a large scale. The electrolytes of the present invention are the most thermodynamicaily stable yet.

SUMMARY OF THE INVENTION

Aluminum (or an alloy thereof) is electroplated upon electrically conductive substrates by immersing the substrate as a cathode in stable electrolytes, which comprises the steps, basically of:

a. reacting a given quantity of aluminum with a hydrogen halide such as HCl, HBr, or HI (but preferably hydrogen bromide) or reacting aluminum with a halogen such as $Cl_2$, $BR_2$ or $I_2$ (but preferably bromine), in the absence of water, but in one of the following single solvents or mixtures thereof: benzene, toluene, carbon disulfide, cyclohexane, dimethyl sulfide, tetrahydrofuran, diiodoethane, toluene-cyclohexane (1:1), benzene, cyclohexane (1:1), THF: benzene (4:1) and toluene-$CS_2$ (3:1) to form an intermediate aluminum halide cation in solution, the concentration of the aluminum cation and the concentration of hydrogen ion, in solution being respectively, below 7.5 M and 0.5 M and preferably being, respectively below 4.2 M and 0.1M; and b. then adding about 0.5 - 16 mole %, relative to the initial amount of aluminum added, of alkali metal halide, MX, where M=Li, Na, or K and X=Cl, Br, or I; or where MX is a special halide such as beryllium, bromide, magnesium bromide, or quaternary ammonium bromide to form a different, stable aluminum cationic plating species.

The novel electrolyte is then directed to a plating chamber, utilized in the plating chamber until it is aluminum ion poor, and transferred to a regeneration chamber, filtered, and returned to the plating chamber for further plating operations.

The hydrogen ion and MX concentrations are highly restricted in order that no competing plating reactions occur, (e.g., to avoid plating of M or $H_2$).

It is possible to place aluminum, hydrogen halide or a halogen, and MX, into a reaction zone, simultaneously, to produce a stable, aluminum cationic plating species, but this is not presently preferred. It is also possible to place an aluminum —M alloy (where M is equivalent to the metal in MX) and hydrogen halide or a halogen, into a reaction zone, simultaneously, to produce the same stable plating species.

The electroplating solutions, and process of this invention have the following characteristics:

1. by the elimination of a volatile substance — hydrogen bromide gas, as the dominant conducting species in the bath, and the substitution, therefor, of 0.5 - 16 mole % (relative to the initial amount of aluminum added) solid alkali metal halide, beryllium bromide, magnesium bromide, or a quaternary ammonium bromide salt, together with a low resistivity solvent system, the resulting plating baths are rendered stable and highly conductive, indefinitely, provided oxygen and water vapor are excluded;
2. the ability to make use of a readily available major solvent, toluene, as the single solvent and also the use of more stable organic solvents, in particular, single solvent systems such as benzene, tetrahydrofuran, dimethyl sulfide, and cyclohexane that are relatively inert to attack by plating by-products;
3. the used electroplating solution of this invention can be transferred from the zone of plating to a regeneration column packed with fine aluminum, which filters off plating by-products such as bromine and permits the electroplating solution to have a substantially longer life;
4. the employment of a mechanical mask at the cathodic substrate, which permits the electrodisposition of aluminum in controlled patterns on the substrate; and
5. the ability to use aluminum anodes in addition to inert anodes such as porous or solid graphite, tantalum, and platinum.

DETAILED DESCRIPTION OF THE PREFERRED EMBODIMENT OF THE INVENTION

A. INTRODUCTION

Figure 1:
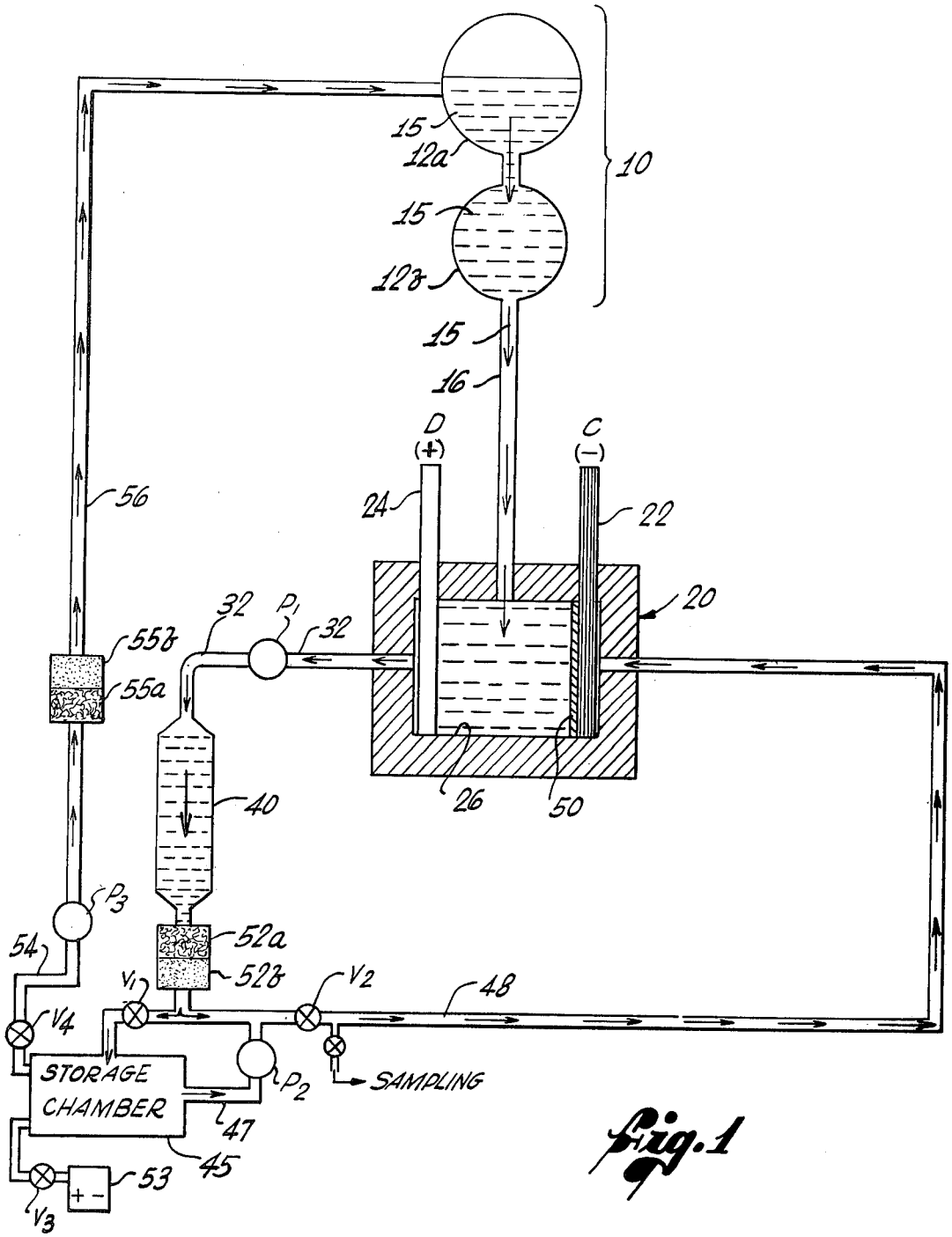
FIG. 1 is a schematic representation of the processing system utilized in this invention.

It is a primary object of the present invention to provide an improved, long life electrolyte for the electrodeposition of high purity aluminum. Another object of the present invention is to provide a novel electroplating bath which is stable to moisture, inexpensive, and easy to prepare and control, thereby providing a commercially feasible aluminum plating system. A still further object is to provide a bath for the electroplating of aluminum, which has a relatively high electrical conductivity, low voltage requirements and in which high electrode efficiencies are obtainable.

A still further object is to provide a generalized electroplating process which can be modified and broadened for other industrial applications.

Although the invention described in Ser. No. 645,552 also relates to the electrodeposition of aluminum from two relatively inexpensive, conductive stable organic electrolytes to produce a bright, adherent, ductile deposit of high purity aluminum, and these electrolytes are feasible for industrial application; further improvements in the electrolytic system are set forth herein.

In Ser. No. 645,552, both the Toluene-Hydrogen Bromide-Aluminum Bromide and Ethyl Bromide-Toluene-Hydrogen Bromide-Aluminum Bromide Systems use toluene as the primary solvent. Since in these systems for every aluminum atom deposited, three atoms of bromide are released, as byproducts, the plating baths eventually build up a high concentration of bromine and bromide ions. Since toluene is also a mild "bromide-getter", the following side reaction can occur:

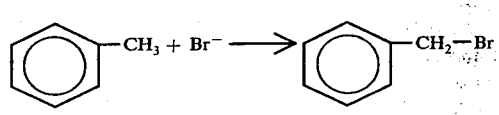

(I)

Thus, eventually the electrolyte becomes very viscous, the current densities decrease, the throwing power decreases; and the electrolyte finally yields black deposits of aluminum. However, in the present invention, the use of toluene may be entirely avoided, if desired, and the preferred solvents used are benzene, tetrahydrofuran, dimethyl sulfide, cyclohexane, and carbon disulfide which are relatively inert to attack by the by-products of plating.

It has also been found, in using both the Toluene-Hydrogen Bromide-Aluminum Bromide and Ethyl Bromide-Toluene-Hydrogen Bromide-Aluminum Bromide Systems of said copending application, Ser. No. 645,552 that both these plating systems depend on hydrogen bromide as the major conductivity ingredient of the electrolyte. Since hydrogen bromide gas itself is relatively volatile, the hydrogen ion concentration end point of the electrolyte, which affects the plating quality and throwing power of the electrolyte, is somewhat difficult to maintain or equilibriate during long periods of electroplating. In other words, as the conductivity of these electrolytes change during plating so will the electrode efficiences, throwing power of the electrolyte, and ultimately the plating quality also changes. Furthermore, the stability of the plating hydroaluminum bromide complex of Ser. No. 645,552, $[Al_2 Br_4 H.ArH]+$, can be improved (although it is adequate for high quality plating) by the substitution of the hydrogen bromide gas with a restricted amount of a stable solid salt, MX, (where M=Li, Na, K and S=Cl, Br, i; or special bromides such as $BeBr_2$, $MgBr_2$ and $NH_4Br$), to form the major conductivity species in the electrolyte.

Another innovation of the present invention is that as soon as the by-products of plating (halogens or halides) are released during plating, they are immediately directed by a mechanical pump (or by gravity, in some instances) from the zone of plating to a regeneration column packed with fine, activated aluminum which absorbs the by-products. The halogens or halides are allowed to react with the fine, activated, aluminum to regenerate more aluminum halide plating species, which is then available for replacement of the aluminum halide ions consumed in the plating process.

Hence, the present invention is a balanced cycle in which the amount of aluminum consumed during plating theoretically equals the amount of aluminum dissolved, provided that factors such as oxygen, water vapor, and solvent evaporation are controlled. Such column treatment re-establishes the equilibrium altered during plating.

B. ELECTROPLATING SOLUTION FORMATION, CHEMISTRY, AND ELECTROPLATING PROCESS

The electroplating solutions of this invention are formed in the following manner.

A given quantity of pure aluminum, or an alloy of aluminum, is reacted with hydrogen halide, or a halogen, in the presence of an organic, substantially anhydrous, non-Lewis base solvent, previously generally described, and in the absence of oxygen. The reaction commences at room temperature but the heat of reaction increases the temperature on the order of about 30° C. After the reaction reaches equilibrium, substantially all of the aluminum is in solution as a complex cationic species, as will be later described.

The initial amount of aluminum entering into the reaction is such that the final aluminum ion $[Al^{+3}]$ molarity, at equilibrium, is below 7.5 M, and preferably below 4.2 M. The higher the $Al^{+3}$ ion concentration, the higher the resistivity of the ultimate plating solution, and for this reason, the lower aluminum ion concentrations are preferred.

The amount of halogen or hydrogen bromide, added to the reaction vessel or zone is in excess of that required to produce an aluminum halide (e.g., 3:1 molar ratio of bromine: aluminum or 3:1 molar ratio of HBr: aluminum to produce $Al_2Br_6$). The aluminum cationic species formed in the reaction appears to be a complex aluminum cationic species (see Equations II and III infra) rather than simply an aluminum halide. But the reaction, nevertheless, requires at least that quantity of hydrogen halide or halogen sufficient to produce an aluminum halide. The excess amount of any hydrogen bromide added cannot, however, be so large as to result in a $H^+$ ion concentration of about 0.5 molar, in the solution. The $H^+$ ion concentration should be as low as possible, to prevent hydrogen formation at the cathode or other side reactions, and preferably the $H^+$ ion concentration should be below 0.1 M and even as low as 0.01 M, if possible.

A restricted amount of a metallic halide (MX) is then added to the equilibriated solution above-described. The metallic halide is selected from the halides of Lithium, Sodium, Potassium, Beryllium, Magnesium, and Ammonium ions. The amount of MX added is preferably below 16 mole %, relative to the initial molar amount of aluminum entering the reaction and lies preferably between 0.5 - 16 mole %. Thus, if 7 moles of aluminum are placed into the reaction, the resulting solution, after all reactions have taken place, and equilibrium has been reached, may equal 2 liters, in which case a 3.5 molar[$AL^{+}3$] ion concentration is present. However, a 10 mole % addition of MX based on the initial molar amount of aluminum would equal a 0.7 mole MX addition. Concentrations above about 16 mole % MX, relative to initial aluminum present in solution, create a non-aluminum plating solution, since other reactions appear to be taking place involving deposition of the $M^+$ ion.

While it is preferred that the aluminum halide species be entirely formed prior to addition of MX, it is feasible to introduce aluminum, the hydrogen halide or halogen, and the MX simultaneously into solution, and have an operable electroplating solution. The stepwise reaction procedure, above-described, is presently preferred because the MX appears to be dissolved faster in the presence of the first-formed aluminum halide cationic species.

The reaction of hydrogen halide with aluminum appears to generate aluminum halide, in complex form in situ, (see Equation II below):

$$\text{(II)}\ 2\,Al + ArH + 6HX \rightarrow [Al_2X_5.ArH]^+ + X^- + 3H_2$$

wherein ArH is benzene, toluene, THF, dimethyl sulfide, diiodoethane, cyclohexane, or $CS_2$ but preferably benzene or toluene; X is chloride, bromide, or iodide but preferably bromide; $[Al_2X_5.ArH]^+$ is a complex cation.

In said copending patent application, Ser. No. 645,552, hydrogen halide also serves a second function — that of being the major conductivity species in solution.

Halogen may also be reacted with aluminum in place of hydrogen halide to form aluminum halide in complex form in situ, as shown below in Equation III.

$$\text{(III)}\ 2Al + ArH + 3X_2 \rightarrow [Al_2X_5.ArH]^+ + X^-$$

wherein $X_2$ is chlorine, bromine, or iodine.

In the second stage of the reaction (when the ionic (metal) halide is added) it has been found that optimal plating is achieved if the ionic halide salt is added after the aluminum halide has been formed in complex in situ, as mentioned previously. Some of the metal halides added appear to react with the complex aluminum cation (see Eqt. II and III) in solution to form a plating metal $\pi$-complex cation* as illustrated below:

$$\text{(IV)}\ MX + [Al_2X_5.ArH] + \rightarrow [Al_2X_4M.ArH]^+ + X_2$$

wherein MX is an ionic (metal) halide, and
$M = Li^+, Na^+, K^+, Be^{++}, Mg^{++}, NH^+_4$,
$X = Cl^-, Br^-, I^-$; and
$[Al_2X_4M.ArH]^+$ is a metal $\pi$-complex cation.

* $\pi$ - complex cation = a plating complex cation.

The rest of the metal halides in solution serve two functions: (i) to increase the conductivity of the solution; and (ii) to improve the throwing power of the bath. These MX salts appear to combine with aluminum halide to produce in anionic form:

$$\text{(V)}\ MX + Al_2X_6 \rightarrow Al_2X_7^{(-)} + M^{(+)}$$

The just-referred to substantially anhydrous plating solution, containing $\pi$-complex cations, which is prepared in a reaction vessel or zone, is then directed to an electrolytic or plating cell in which aluminum is electrodeposited on an electrically conducting cathodic substrate.

Referring to FIG. 1, the reaction zone 10 includes one or more reactors 12 in which the basic reagents aluminum, a halide source, and MX have been thoroughly mixed and reacted, as above-described to form the fresh electrolyte 15 of this invention. The fresh electrolyte 15 is then transferred, by suitable and conventional means, e.g., a pump (not shown) via line 16 into an electrolytic cell 20.

The cathode 22 of cell 20 may comprise any electrically conductive material upon which aluminum is to be plated. However, the preferred cathode 22 is a metallic substrate. As mentioned previously, the preferred anode 24 is the aluminum anode although inert anodes may be used with excellent results.

The plating chamber 26 of cell 20 is basically an enclosed area that contains the anode and cathode separated at distances of from about 0.030 inch to about 1.000 inch. The electrolyte 15 enters the chamber 26 from the reaction zone(s) 12*a*, 12*b* via line 16. The used or spent electrolyte is preferably continuously withdrawn from the plating chamber 26 by pump $P_1$ after the aluminum cationic plating species has been depleted to some small extent and is then fed via line 32 to a regeneration column 40, packed with fine, activated aluminum.* The aluminum cation plating species (see Equations III, IV, and VI (below) is thereby replenished or enriched.

$$\text{(VI)}\ 2\,Al + ArH + 2X_3^- \rightarrow [Al_2X_5.ArH]^+ + X^-$$

* Activated aluminum is prepared by degreasing 99.9% pure aluminum with a toluene-hexane admixture, washing with KOH, rinsing with water and methanol, and washing in the final solvent used as the reaction solvent.

After passage through the regeneration column 40, the enriched electrolyte may be filtered, e.g., in a combination filter comprising a woven glass bed 52*a*, and a sand bed 52*b*, to remove any suspended aluminum and other contaminants, such as polymers and preferably returned directly to the plating chamber 26 via line 48. If it is desired to introduce some additional fresh electroplating solution from reactors 12*a* and 12*b*, some enriched electrolyte may be held in storage chamber 45 for return to plating chamber 26 by means of pump $P_2$ via lines 47, 48, when required.

Valves $V_1$ and $V_2$ are placed in appropriate lines, as shown, to direct the enriched solution, as desired. The sampling of enriched electroplating solution, to check increased $[Al^{+3}]$ molarity and/or resistivity, occurs by taking samples, from return line 48.

By following the above procedure, the by-products of plating (halogen and halide) will not accumulate in such large concentrations in the plating chamber 26 such that they will attack either the plated aluminum 50, on the cathode 22 or the solvent (if toluene is used). Thus, as aluminum is being plated onto the cathode 22, the released by-products of plating are directed away from the cathode 22 towards the anode 24 such that some of the by-products react with the (aluminum) anode 24 to form new aluminum cation plating species while the remainder of the by-products are trapped by the regenerating column 40 in which the by-products are re-converted to new aluminum cation plating species, thereby replenishing or enriching the solution (see equations III, IV, and VI).

Although the electroplating process described, to this point, is a balanced cycle in which theoretically at least the electrolyte is stable indefinitely and electroplating can be performed indefinitely, the electrolyte may tend to deteriorate after long periods of continuous plating because of the following considerations:

a. Evaporation of solvent can occur. Such evaporation will increase the viscosity of the electrolyte and lower its conductivity. As this happens, the electrolyte 15 in the plating chamber 26 gets heated during plating, which increases the probability of attack of solvent by the plating by-products;
b. Some water and oxygen from the air may get into the process cycle; which produces contaminants such as $Al_2O_3$, $Al_2(OH)_3$, etc.; and
c. The rate of plating is more rapid than the rate of reaction of the by-products of plating with aluminum to form new aluminum cationic plating species. Eventually some by-products pass through both the aluminum anode 24 and regeneration column 40 unaltered such that these by-products would eventually concentrate to such high levels that the equilibrium of the electrolyte is altered.

Thus, after long periods of plating, it is presently preferred to incorporate into the process system, above-described, a recirculation of high viscosity, high resistivity electrolyte to reaction vessel(s) 12*a*, 12*b*. This is accomplished by sending deteriorating electrolyte to storage chamber 45 from regenerating bed 40.

More specifically, in response to an appropriate signal from a conductivity probe 53, indicating a high given resistivity (e.g., above 400 ohm/cm) in the electrolyte in storage chamber 45, the electrolyte will be pumped, via pump $P_3$ through open valve $V_4$ and line 54, to a combination filtration bed 55*a*, 55*b* of the same type as filtration bed 52*a*, 52*b*. The high resistivity electrolyte is then sent to reaction zone 12*a* after filtration, via line 56 and treated with fresh solvent, aluminum, MX, and hydrogen halide to synthesize new aluminum cation plating species. After the electrolyte has fully been synthesized, it is again transferred to the cell 20 to enter the plating cycle once again. Alternatively, of course, the deteriorating electrolyte could be discharged from the plating cycle or system, entirely, and completely fresh electroplating solution be made.

C. THE SOLVENTS

The particular solvent employed is preferably one in which the cationic aluminum bromide and hydroaluminum bromide cations are relatively soluble, and which does not contain groups which would provide competing reactions in the system. It has been found that the following solvents may be employed:

benzene, toluene, tetrahydrofuran (THF), cyclohexane, dimethyl sulfide, diiodoethane and carbon disulfide. All of the solvents are organic substantially anhydrous, non-Lewis base solvents. Although it will be seen from the specific examples presented hereinafter that a wide range of mixtures of the above solvents provide satisfactory aluminum deposits, a single solvent system is preferred.

In general, a single solvent system is the least expensive and most convenient solvent due to its relatively low viscosity. It is perferable to maintain the viscosity at relatively low levels to avoid mechanical problems of pumping the solution; and low viscosity solutions produce the best current densities. Furthermore, single solvent systems normally afford superior aluminum deposits than solvent mixtures. Thus, the concentration of aluminum bromide in solution should be from about 3.0 M to about 4.2 M and optimally, between about 3.5 M to 4.2 M, although plating can be accomplished with aluminum bromide concentrations up to 7.5 M. The use of benzene and toluene is preferred because the former is relatively inert to attack from plating by-products. Cyclohexane is inert to attack from plating by-products, but the solubility of aluminum bromide and ionic halide is not as great in cyclohexane as in benzene and toluene. Carbon disulfide is the least desirable of the single solvents because it not only has a pungent, foul odor, but also the resulting $CS_2$ electrolyte is relatively viscous.

D. THE HALIDE SOURCE

The preferable halide is bromide because hydrogen chloride as the reactant with aluminum to form aluminum chloride is relatively insoluble in organic solvents such as benzene, toluene, and cyclohexane, with a few exceptions such as THF, dimethyl sulfide and carbon disulfide. Hydrogen iodide is acceptable except that the resulting aluminum iodide in situ is more viscous than aluminum bromide. It should be pointed out that a wide range of mixtures of the above aluminum halides provide satisfactory results, but a single aluminum halide is preferred in all instances (See Tables I and II).

E. THE MX SALTS

The amount of ionic halide salts, MX, that is added is dependent on the initial concentration of aluminum added. One might surmise that the upper limit of ionic salt concentration should not exceed the molar ratio of $MX:AlX_3$ (1:2) corresponding to the formation of $Al_2X_7{-}M^{(+)}$. However, it has been discovered that too high a concentration of these MX species in solution appears to prevent plating of aluminum, whereas a moderately high concentration of MX causes the incorporation of these salts in the electrodeposit along with aluminum. To prevent such effects, it has been found that the concentrations of MX should, preferably, be from about 0.5 to 16 mole % relative to the quantity of aluminum initially added.

The types of ionic halide salts, MX, that are useful for the present invention must contain two criteria: (a) the radii of the cations are relatively small in order to allow the ions to transfer from one complex to another in a viscous solution. Thus, cations from Group I and Group II elements of the Periodic Table such as $Li^+$, $NA^+$, $K^+$, $Be^{++}$, $Mg^{++}$, and a special case, $NH_4^+$, all fit the first criteria; (b) the ionic salts, MX, must have sufficiently high ionization potentials compared to aluminum such that the salts would not easily codeposit along with the aluminum. Thus, salts of heavy metals such as copper and iron, interfere with the plating of aluminum. It is always easier to electroplate copper and iron than aluminum.

The halide, X, of the MX used may be a chloride, bromide, or iodide. However, in general, the halide should be the same halide as that of the aluminum halide used at the time for the purpose of simplicity - and also to eliminate possible contaminants. It has been found that the addition of halides of $Li^+$, $Na^+$, $K^+$, $Be^{++}$, $Mg^{++}$, and $NH_4^+$ gives indistinguishable results, although the preferred metal halide is potassium bromide. For the purposes of this specification and claims, the $NH_4^+$ ion will be defined as a metallic ion.

F. THE OPTIMAL SOLUTIONS AND PROCESS CONSIDERATIONS

Hence, the optimal plating solution of the present invention contains the following parameters:

1. The final aluminum bromide concentration is from about 3.0 M to about 4.2 M;
2. The preferable metallic halide salt is potassium bromide; its concentration in solution preferably lies in the range of from about 0.5 to about 16 mole % relative to the initial concentration of aluminum in solution;
3. Benzene and toluene are the presently preferred solvents with benzene being the solvent of choice;
4. The resistivity of the plating solution is from about 100 to 400 ohm centimeters;
5. The best cathode efficiency observed is 100%; and
6. The best current density is about 125 milliamperes per square centimeter.

The optimum electrolytes of this invention have been found to be still active even after one week of continuous, non-stop electroplating. The freshly made electrolyte is from dark orange to chocolate-brown in color. However, after exposure to light the color turns black.

When a solution of the foregoing type is then directed to the electroplating cell 20 of FIG. 1, the following reactions may occur at the cathode 22:

$$\text{(VII)}\ [Al_2Br_4K.ArH]^+ + 3e^- \rightarrow 2\,Al + ArH + KBr + 3\,Br^-PS$$

$$\text{(VIII)}\ 7\,Al_2Br_6 + 6e^- \rightarrow 2\,Al + 6\,Al_2Br^-_7$$

The aluminum plated onto cathode 22 is designated by the numeral 50.

At the anode 24, the following reaction may occur if toluene is the solvent and the anode used is an insert anode:

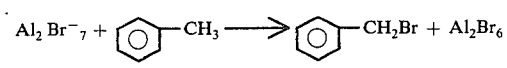

(IX)

However, if an aluminum anode is used and the solvent used is one of benzene, cyclohexane, THF, or $CS_2$, the only reaction that occurs is the slow dissolution of the aluminum anode by the by-products of plating, which replenishes the aluminum bromide consumed during plating. (See Equations III and VI).

Before plating, the cathode is degreased with methanol, etched in an acid mixture consisting of 25% $H_2O$, 25% $H_3PO_4$, 25% $HNO_3$, and 25% $CH_3COOH$, washed in distilled water, rinsed in methanol and dried. For alloy-42 and steel surfaces, the cathodes are treated with sandpaper, etched in 2N HCl, washed with distilled water, rinsed with methanol, and dried.

It has been found that the plating baths herein described plate effectively at voltage drops of from about 1.6 to about 3.0 volts, when the cathode and anode are separated at distances of from 0.030 inch to 0.050 inch. Under these conditions for a 10 minute plating, the maximum thickness of plating is about 500 micro inches. Voltages of up to about 5.0 volts may be required when cathode and anode are spaced further apart, e.g., up to about a 1 inch spacing.

Figure 2:
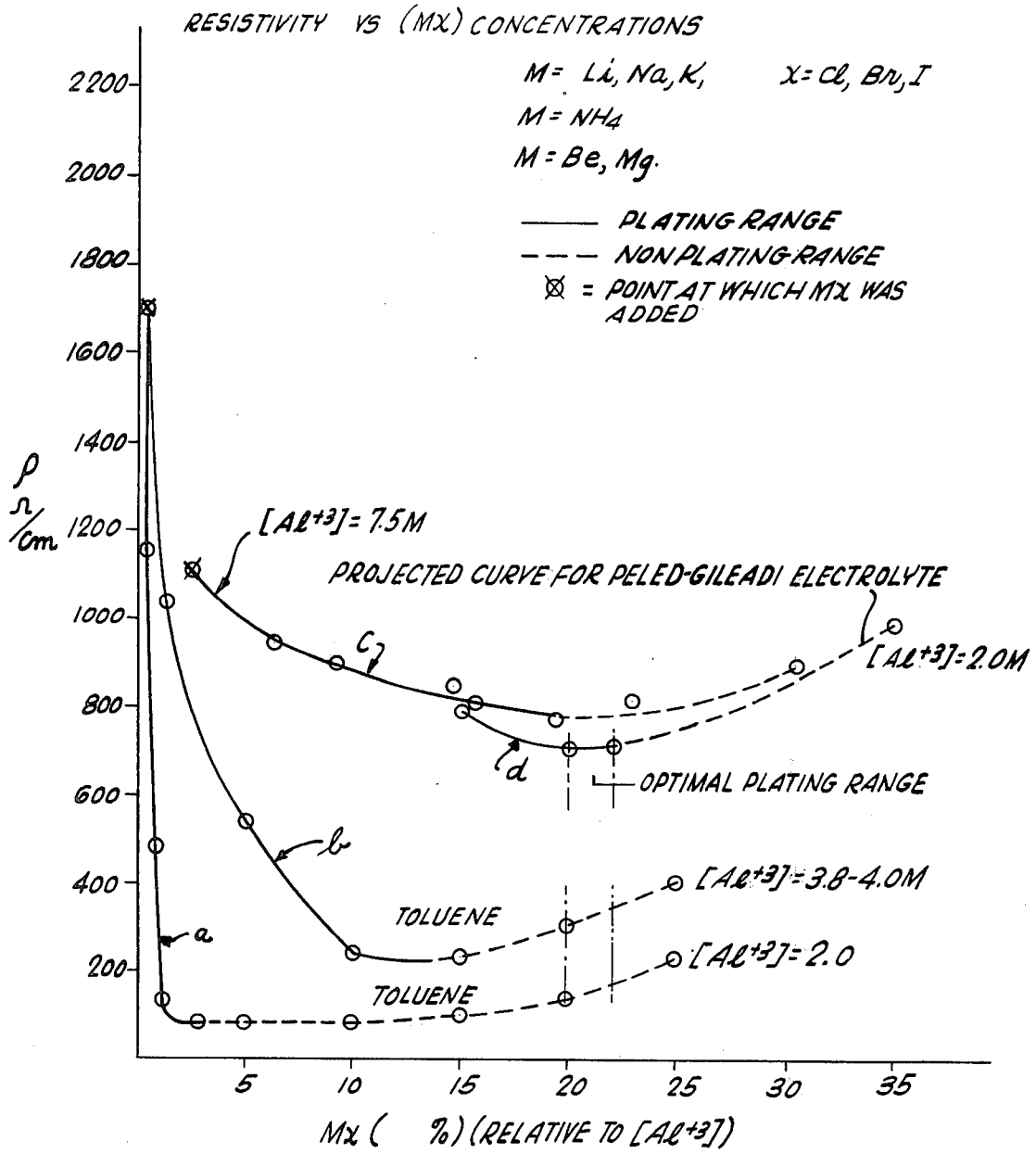
FIG. 2 is a graph of resistivity of various electrolytes utilized in this invention and by others vs. concentration of alkali halide (MX), relative to the initial quantity of aluminum added.

Referring now to FIG. 2, a plot of various plating solutions vs MX concentration is shown. Curves a, b, and c are plots of plating solutions of this invention, containing 2.0 molar, 3.8–4.0 molar and about 7.5 molar [$Al^{+3}$] concentrations, in toluene, respectively, and containing varying amounts of MX, relative to the initial [$Al^{+}$3] added to the plating solution. Curve *d* is a similar type of plot for a Peled-Gileadi plating bath containing 2:1 molar ratio of toluene to ethylbenzene, and a 2.0 molar [$Al^{+3}$] concentration.

The preferable plating solutions of curves *a* and *b* are those which have resistivities of from between about 100 – 400 ohm/cm. and which utilize initial [$Al^{+3}$] concentrations of below about 4.0 molar and between 0.5 – 16 mole % MX, relative to the initial [$Al^{+3}$] concentration. These plating solutions have substantially lower resistivity than the Peled-Gileadi plating solution, curve *d*, (which for a 2.0 molar initial [$Al^{+3}$] has an optimum resistivity of approximately 700 ohm/cm). In the case of applicant's curve *c*, the optimum resistivity is also high (about 800 ohm/cm) but it should be borne in mind that this solution contains an initial very high (7.5 molar) [$Al^{+3}$] concentration and does not contain a Lewis base. The optimal MX concentration, for curve *d*, is about 16 – 20 mole %, relative to initial [$Al^{+3}$] concentration. From the foregoing, it will be seen that initial [$Al^{+}$3] concentrations of as high as 7.5 Molar and as high as 20 mole % MX may be utilized, if one does not object to high solution resistivity of about 700 – 800 ohm/cm. and consequent high current density. It is presently highly preferred to work with those portions of curves *a* and *b*, and solutions falling between these curves, which have resistivities of the order of 100 – 400 ohm/centimeter, initial [$Al^{+3}$] molar concentrations of below about 4.0 molar, and MX concentrations of between about 0.5 – 16 mole percent.

G. CONTROLLED ALUMINUM DEPOSITION

Electrodeposition of aluminum in controlled patterns is accomplished by employing a mechanical mask. This plating method is also referred to as "spot-plating". By placing a mechanical mask over the cathode, the cathode areas covered by the mask will not be plated while the cathode areas not covered by the mask will be electroplated with aluminum. This electrodeposition of aluminum in controlled patterns is possible for aluminum but fails for other elements such as Cu and Fe because organic electrolytes of aluminum have much smaller current densities and throwing power compared to aqueous electrolytes of the majority of elements. The electrodeposition of aluminum usually proceeds via line of sight of plating, i.e., it is only possible to plate onto uncovered areas of the cathode directly facing the anode. Thus, in the case of elements such as Fe, Cu and Ag, there is usually plating on areas underneath the mechanical mask as well as on the "backside" of the cathode, i.e., the side of the cathode that is not facing the anode.

Suitable materials for mechanical masks must contain two criteria: (i) they are electrically non-conductive while at the same time are hard and capable of being cut into thin sheets; (ii) they are chemically inert to attack by the organic electrolytes of aluminum. It has been discovered that Teflon®, polyphenolic materials, polyfluoroethylpropyl materials (FEP), and polyvinylchloride provide excellent masking materials in the electrodeposition of aluminum in controlled patterns.

H. ANODE CONSIDERATIONS

It has been found in Ser. No. 645,552 that high purity aluminum can be electrodeposited when inert anodes such as porous and solid graphites, tantalum, or platinum are used. However, with regard to porous and solid graphite, it has been discovered that only fresh graphite anodes yield excellent plating. As time passes, the plating efficiences and qualities decline progressively. The electrolytes slowly attack the anode during plating. Eventually, an organic polymeric film is formed over the anode at the zone of plating, which increases the resistance of the anode. Another disadvantage of the graphite anodes is that after a plating run the anodes cannot be regenerated and stored for future use; they have to be discarded. In the case of tantalum and platinum anodes, although they can be reused indefinitely, they must be cleaned after each plating run since an organic film is deposited on the anode, which also increases the resistance of the anode. On the other hand, the present invention incorporates an aluminum anode, principally, although the inert anodes cited above can also be used.

The main advantage of aluminum anodes over the inert anodes is that as the concentration of the plating by-products increase, these by-products will attack the aluminum anode, instead of the solvent, causing anodic dissolution. Hence, the equilibrium of the plating species in the electrolyte is maintained, which permits the electrolyte to have a longer life. Another advantage of the aluminum anode over graphite anodes is that the aluminum anode can be re-used as it is not totally dissolved. But, eventually, the aluminum anode will need to be replaced.

I. OTHER PROCESS CONSIDERATIONS

While, as stated, it is presently preferred to recirculate electroplating solution, from cell 20, to the regeneration column 40, filters 52, 52*b*, and return to the cell 20, via line 48, on a continuous basis, regeneration and recirculation could also be accomplished after a given period of plating, e.g., 10 minutes, 1 hour, 10 hours, etc. has taken place within cell 20. In any event, the aluminum ion molarity (and/or resistivity) of the electroplating solution, within cell 20, will measurably change after even a very short plating run, and will result in an aluminum cation poor solution relative to that of the initial fresh or enriched electroplating solution.

It will be understood that the process herein contemplated may be employed with aluminum halide cationic plating species, or with aluminum cationic plating species other than those specifically set forth here by way of example.

J. EXPERIMENTAL SECTION AND EXAMPLES i. Introduction

The conductance and resistivity of the electrolytes were determined by using a YSI-1095 Platinum Conductivity Cell (Cell K=1.0).

In the analyses of the $[Al^{+3}]$ and $[Br^-]$ concentrations of the electrolytes, the following procedures were followed: In general, one ml. of electrolyte was decomposed into 2,500 ml. of distilled water using a pressure equalizing funnel and flask. The bromide concentration is determined directly using a bromide electrode (Orion Model 94035A) and an Orion pH meter, which gave readings in millivolts. By means of a standard bromide calibration curve and extrapolation, the millivolt readings were converted into molar concentrations. $[Al^{+3}]$ concentrations were determined by titrating an aqueous solution of the electrolyte (1 ml. electrolyte/100 ml $H_2O$) with a standard sodium hydroxide solution up to the end point pH of 11.00. Analyses for $[Cl^-]$ and $[I^-]$ concentrations were identical to that of the $[Br^-]$.

To test the plating quality of a particular electrolyte an experimental plating assembly was set up as illustrated in FIG. I.

For the electrodeposition of aluminum in controlled patterns a mechanical mask, having the patterns to be electroplated with aluminum cut out of the mask, was placed over the cathode area facing the anode before each plating run. The mechanical masks normally were Teflon or polyphenolic sheets, 0.010 to 0.030 inch thick.

ii. Preparation of Stock Solution A: Benzene-Aluminum Bromide Complex

The apparatus used in the preparation of these electrolytes consisted of a 2,000 ml. 3-neck round bottom flask equipped with a reflux condenser connected to a gas trap, hydrogen bromide inlet tube, argon inlet tube, magnetic stirrer, and water bath.

160 g. of 99.9% aluminum wire were cut into small pieces, and washed with aqueous 2N potassium hydroxide, water (3 times), methanol (3 times) and benzene (3 times). Then, the aluminum was placed into the 2,000 ml 3-neck round bottomed flask under an atmosphere of argon. 800 ml. of reagent-grade benzene were added. Hydrogen bromide gas was bubbled into the mixture with stirring. The rate of addition of HBr was such that the temperature of the mixture did not rise above 30° C. After 15 to 30 minutes, the mixture turned yellow, then orange, and finally dark brown. Hydrogen bromide was bubbled into the mixture until approximately 95% of the solid aluminum have gone into solution. This took approximately 36 hours. Then the mixture was stirred under argon at room temperature overnight to allow the system to reach equilibrium (i.e., to allow the remaining aluminum to absorb the remaining HBr gas in solution). Now this stock solution of benzene-$Al_2Br_6$-complex was ready for treatment with the ionic halide salts. Using the analytical methods described above, the benzene-$Al_2Br_6$-complex stock solution, possessed the following characteristics: The resistivity was between 800 - 1,000 ohm centimeters; the $[H^+]$ concentration was less than 0.08M; and the $[Al^{+3}]$ concentration was 3.8M.

EXAMPLE 1 — Benzene-$Al_2Br_6$ — Li Br 200 ml. of the above stock solution of benzene-$Al_2Br_6$- complex was treated with 10 mole % Li Br relative to aluminum (6.6 g). Using a plating assembly as illustrated in FIG. 1, effective plating was achieved at voltage drops on the order of 2.0 volts. The thickness of plating for a 10 minute period was 400 microinches. The current density was 85 mA/cm$^2$. The cathode efficiency was 100%. The white aluminum deposits observed were 99.9% pure by analysis. The resistivity of the final solution was below 400 ohm/centimeter, as it was for all examples hereinafter set forth, except where specifically noted.

EXAMPLE 2 — Benzene-$Al_2Br_6$ — Na Br 200 ml. of the above stock solution of benzene-$Al_2Br_6$-complex was treated with 10 mole % Na Br relative to aluminum (7.8 g). Using a plating assembly as illustrated in FIG. 1, effective plating was achieved at voltage drops on the order of 2.0 volts. The thickness of plating for a 10 minute period was 425 microinches; the current density was 95 mA/cm$^2$; and the cathode efficiency was 100%. Analytically pure white deposits of aluminum were observed.

EXAMPLE 3 — Benzene — $Al_2Br_6$-KBr 200 ml. of the above stock solution of benzene-$Al_2Br_6$ — complex was treated with 19 mole % KBr relative to aluminum (9.0 g). Using an identical plating assembly as in the above examples, effective plating was achieved at voltage drops on the order of 2.0 volts. The thickness of plating for a 10 minute period was 500 micro-inches and the current density was approximately 125 mA/cm$^2$. The cathode efficiency was 100%. 99.9% pure, white deposits of aluminum were observed.

EXAMPLE 4 — Benzene — $Al_2Br_6$-$NH_4$Br 200 ml. of the above stock solution of benzene-$Al_2Br_6$-complex was treated with 10 mole % $NH_4$Br relative to aluminum (7.4 g). White deposits of aluminum 405 microinches thick, were observed when plating was performed in the FIG. 1 assembly, previously described. The current density was 87 mA/cm$^2$.

EXAMPLE 5: Benzene — $Al_2Br_6$ — Be $Br_2$ 200 ml. of the above stock solution of benzene — $Al_2Br_6$-complex was treated with 10 mole % $BeBr_2$ relative to aluminum (12.8 g). Under identical plating conditions as described with reference to Example 1, the following results were obtained. Thickness of plating was 385 microinches; current density was 70 mA/cm$^2$; and cathode efficiency was 90%.

EXAMPLE 6: Benzene-$Al_2Br_6$-Mg $Br_2$ 200 ml. of the above stock solution of benzene $Al_2Br_6$-complex was treated with 10 mole % Mg $Br_2$ relative to aluminum (14.0 g). Using identical plating conditions as described in EXAMPLE 1, the following results were observed: thickness of plating was 356 microinches; current density was 71 mA/cm$^2$; and cathode efficiency was 89%.

iii. Preparation of Stock Solution B: Toluene-Aluminum Bromide Complex

The procedure for the preparation of the benzene-aluminum bromide complex of Stock Solution A was repeated utilizing 160 g of aluminum and 780 ml. of reagent — grade grade toluene (instead of benzene). This stock solution of toluene-$Al_2Br_6$-complex had a resistivity of 1,700 ohm/centimeter, its $[Al^{+3}]$ concentration was 3.78 M and the $H^+$ion concentration was below 0.1 Molar.

EXAMPLE 7 — Toluene-$Al_2Br_6$ — 5 mole % Li Br

Treating 100 ml. of stock solution B with 5 mole % Li Br relative to aluminum (3.3 g) gave a solution with a resistivity of 550 ohm — centimeters when plating was performed in the FIG. 1 system at 2.2 volts. White deposits of aluminum, 148 microinches in thickness were observed.

EXAMPLE 8 — Toluene — $Al_2Br_6$ — 10 mole % Li Br

Another 5 mole % Li Br relative to aluminum was added to the solution of EXAMPLE 7 to yield a solution with a resistivity of 250 ohm — centimeters. Plating with this solution in the FIG. 1 system at 2.2 volts resulted in white deposits of aluminum, 248 microinches thick.

EXAMPLE 9 — Toluene — $Al_2Br_6$ — 15 mole % Li Br

A further 5 mole % of Li Br was added to the solution of EXAMPLE 8 to yield a solution with a resistivity of 242 ohm-centimeters. When plating was attempted in the FIG. 1 system, using this solution, no deposits of aluminum were observed.

EXAMPLE 10 — Toluene — $Al_2Br_6$ — 20 mole % Li Br

An additional 5 mole % Li Br (3.3 g) was added to the solution of EXAMPLE 9. This solution had a resistivity of 315 ohm-centimeters. However, when plating attempts were made using this solution, in the FIG. 1 system, the results were negative, i.e., no plating of aluminum was observed.

EXAMPLES 11 — 15: Toluene — $Al_2Br_6$ — MBr ($MBr_2$)

One hundred ml. batches of the toluene-$Al_2Br_6$-complex solution (Stock Solution B) were reacted separately with 10 mole %(relative to aluminum concentration) of the following ionic halide salts: Na Br (3.9g), KBr (4.5 g), $NH_4$ Br (3.7 g) Be $Br_2$ (6.4 g), and Mg $Br_2$ (7.0 g). The resulting solutions were investigated to determine whether electrodeposition of aluminum was feasible using these solutions. In general, when plating was performed using each of the above solutions in a FIG. 1 plating system, indistinguishable results were observed. White deposits of 99.9% pure aluminum were observed in each instance.

EXAMPLE 16: Preparation of $Al_2Cl_6$ Electrolytes

Using an identical apparatus and procedure as described above in the preparation of stock solution A, hydrogen chloride gas or chlorine gas was allowed to react with the aluminum instead of hydrogen bromide gas.

EXAMPLE 17 — Preparation of $Al_2I_6$ Electrolytes

Using an identical apparatus and basically similar procedure as described in the preparation of Stock Solution A, the following procedure was carried out: Instead of bubbling hydrogen bromide gas into the mixture of aluminum metal and solvent, iodine crystals were added to the mixture in small portions such that the reaction would not be too vigorous.

Plating electrolyte systems employing both Stock Solutions A and B are summarized below in TABLE I. In TABLE II, other solutions, employing solvent mixtures or solvents other than benzene or toluene, are summarized.

TABLE I

| EXAMPLE | COMPLEX | | RELATIVE RATING | TYPE OF DEPOSITS AND COMMENTS |
|---|---|---|---|---|
| 18 | Benzene - $Al_2Br_6$ (3.8M) | - LiBr (10 Mole %) | Excellent | White, ductile |
| 19 | Benzene - $Al_2Br_6$ (3.8M) | - NaBr (10 Mole %) | Excellent | White, smooth |
| 20 | Benzene - $Al_2Br_6$ (3.8M) | - KBr (10 Mole %) | Excellent | White, smooth |
| 21 | Benzene - $Al_2Br_6$ (3.8M) | - $NH_4Br$ (10 Mole %) | Very Good | White, fairly adherent |
| 22 | Benzene - $Al_2Br_6$ (3.8M) | - $BeBr_2$ (10 Mole %) | Good | White, brittle |
| 23 | Benzene - $Al_2Br_6$ (3.8M) | - $MgBr_2$ (10 Mole %) | Good | White, poor adherence |
| 24 | Toluene - $Al_2Br_6$ (3.78M) | - LiBr (12 Mole %) | Excellent | White, ductile |
| 25 | Toluene - $Al_2Br_6$ (3.78M) | - NaBr (12 Mole %) | Excellent | White, adherent |
| 26 | Toluene - $Al_2Br_6$ (3.78M) | - KBr (12 Mole %) | Excellent | White, adherent |
| 27 | Toluene - $Al_2Br_6$ (3.78M) | - $NH_4Br$ (10 Mole %) | Very Good | White, fairly adherent |
| 28 | Toluene - $Al_2Br_6$ (3.78M) | - $BeBr_2$ (10 Mole %) | Good | White, brittle |
| 29 | Toluene - $Al_2Br_6$ (3.78M) | - $MgBr_2$ (8 Mole %) | Good | White, poor adherence |
| 30 | Toluene - $Al_2I_6$ (2.8M) | - NaI (5 Mole %) | Good | Off-white, adherent |

TABLE II

| EXAMPLE | COMPLEX | RELATIVE RATING | TYPE OF DEPOSITS AND COMMENTS |
|---|---|---|---|
| 31 | Cyclohexane - $Al_2Br_6$ (3.2M) - KBr (11 Mole %) | Fair | White, thin film, $[Al^{+3}]$ concentration is. lower than normal |
| 32 | Cyclohexane: benzene (1:1) - $Al_2Br_6$ (3.5M) - KBr - (10 Mole %) | Good | White, smooth |
| 33 | Cyclohexane: toluene (1:1) $Al_2Br_6$ (4.1M) - KBr - (15 Mole %) | Good | White, smooth |
| 34 | $CS_2$ - $Al_2Br_6$ (3.0M) - KBr - (7 Mole %) | Poor | Grey to black deposits |
| 35 | $[CH_3]_2S$ - $Al_2Cl_6$ (3.9M) - KCl - (10 Mole %) | Fair | Grey, adherent |
| 36 | THF - $Al_2Cl_6$ (3.0M) - LiCl - (10 Mole %) | Good | White, smooth |
| 37 | $CS_2$: toluene (1.3) $Al_2Br_6$ (3.5M) - NaBr (11 Mole %) | Poor | Grey to black deposits |
| 38 | $C_2H_4I_2$ - $Al_2I_6$ (3.2M) - NaI (6 Mole %) | Fair | Grey deposits |
| 39 | THF: Benzene (4:1) $Al_2Br_6$ and $Al_2Cl_6$ (1:1) (4.0M) - KBr:KCl(1:1) (12 Mole %) | Excellent | White, smooth, brittle |

Modifications of the foregoing will become apparent to those skilled in the art. I intend, therefore, to be bound only by the scope of the claims which follow.

I claim:

1. In a continuous plating process, the steps of:
   a. forming a fresh electroplating solution containing an aluminum cationic plating species;
   b. transferring said fresh electroplating solution to a plating cell;
   c. depositing aluminum onto a cathodic substrate within said plating cell at low voltages on the order of less than five volts to produce an electroplating solution which is aluminum-cation poor;
   d. transferring said aluminum-cation poor electroplating solution to a regeneration zone including activated aluminum for reaction of said aluminum-cation poor electroplating solution with said activated aluminum to produce an enriched electroplating solution, having an aluminum cationic plating species with an aluminum ion molarity greater than that of said aluminum-cation poor electroplating solution; and
   e. returning said thusly enriched electroplating solution, to said plating cell for further plating of aluminum therefrom.

2. The plating process of claim 1 wherein said fresh electroplating solution contains an aluminum cationic plating species of below 7.5 molar, and said enriched electroplating solution contains an aluminum cationic plating species of below 7.5 molar.

3. The continuous plating process of claim 1 said fresh electroplating solution contains an aluminum cationic plating species of below 4.2 molar, and said enriched electroplating solution contains an aluminum cationic plating species of below 4.2 molar.

4. The continuous plating process of claim 1 wherein both said fresh and enriched electroplating solutions have a resistivity of between about 100 to 400 ohm/centimeter.

5. The continuous plating process of claim 1 characterized by the filtration of said enriched electroplating solution, to remove suspended aluminum and other contaminant particles therefrom, prior to returning said enriched electroplating solution to said electroplating cell.

6. The continuous plating process of claim 1 characterized by the introduction of fresh electroplating solution, along with said enriched electroplating solution, into said plating cell.

7. The continuous plating process of claim 1 characterized by the masking of selected portions of said cathodic substrate cathodes, to be plated, with an electrically non-conductive and chemically inert masking material.

8. In a continuous plating process, the steps of:
   a. forming a fresh electroplating solution by reacting a given quantity of aluminum, in the presence of an organic, substantially anhydrous, non-Lewis base solvent, with
      i. a member of the group consisting essentially of a halogen and a hydrogen halide in a quantity in excess of that required to produce an aluminum halide but below that required to produce a hydrogen ion concentration of less than about 0.5 molar, and with (ii) about 0.5 – 20 mole % metallic halide, based on the initial mole quantity of said aluminum, said metallic halide being selected from the group consisting of the halides of Lithium, Sodium, Potassium, Beryllium, Magnesium and the Ammonium ion, to form a plating solution containing an aluminum cationic plating species having an aluminum ion molarity of below about 7.5 molar;
   b. transferring said fresh electroplating solution to a plating cell;
   c. depositing aluminum onto a cathodic substrate within said plating cell at low voltages, on the order of less than five volts, to produce an electroplating solution that is aluminum-cation poor;
   d. transferring said aluminum-cation poor electroplating solution to a regeneration zone including activated aluminum for reaction of said aluminum-cation poor electroplating solution with said activated aluminum to produce an enriched electroplating solution, having an aluminum cationic plating species with an aluminum ion molarity substantially greater than that of said aluminum-cation poor electroplating solution; and
   e. returning said thusly enriched electroplating solution, to said plating cell for further plating of aluminum therefrom.

9. The continuous plating process of claim 8 characterized by the filtration of said enriched electroplating solution, to remove suspended aluminum particles and contaminants therefrom, prior to returning said enriched electroplating solution to said electroplating cell.

10. The continuous plating process of claim 8 characterized by the introduction of fresh electroplating solution, along with said enriched electroplating solution, into said plating cell.

11. The continuous plating process of claim 8 characterized by the masking of selected portions of said cathodic substrate cathodes, to be plated, with an electrically non-conductive and chemically inert masking material.

12. In the process of claim 8, the solvent which consists essentially of benzene, toluene, carbon disulfide, cyclohexane, dimethylsulfide, tetrahydrofuran and diiodoethane.

13. The process of claim 8 in which said hydrogen halide or halogen is supplied in a molar ratio with the aluminum of at least 3:1.

14. The method of claim 8 in which the said aluminum ion molarity of said fresh and enriched electroplating solution is maintained below about 4.2 molar during plating.

15. The continuous plating process of claim 8 wherein said metallic halide concentration is less than 16 mole % based on the initial quantity of said aluminum.

16. The continuous plating process of claim 8 wherein the distance between said cathodic substrate and anode within said plating cell is less than about one inch.

17. The continuous plating process of claim 1 wherein said electroplating solution produced in step c) contains a source of halide ion selected from the group consisting of halogen and halide ion, and said reaction of said aluminum-cation poor electroplating solution with said activated aluminum takes place in the presence of said halide source to produce said enriched electroplating solution.

18. The continuous plating process of claim 8 wherein said plating voltage is below about 3 volts and the distance between said cathodic substrate and an anode within said plating cell is less than about 0.05 inches.

19. The continuous plating process of claim 8 wherein an anode within said plating cell is made of aluminum.

20. The continuous plating process of claim 18 wherein an anode within said plating cell is made of aluminum.

21. The continuous plating process of claim 1 wherein said electroplating solution is removed from said plating process after it has attained a predetermined high resistivity.

22. The continuous plating process of claim 1 which includes the steps of:

measuring the resistivity of said electroplating solution formed in step d) and withdrawing said electroplating solution from said plating process after said solution has attained a predetermined high resistivity.

23. The continuous plating process of claim 1 which includes the steps of:

measuring the resistivity of said electroplating solution formed in step d) and reacting said withdrawn electroplating solution to form additional fresh aluminum cationic plating species.

* * * * *